US005316060A

United States Patent [19]

Hodgdon et al.

[11] Patent Number: 5,316,060

[45] Date of Patent: May 31, 1994

[54] REFUSE COLLECTOR WITH HINGED COLLECTION TRAY FOR USE WITH A TRASH BAG

[76] Inventors: Marion Y. Hodgdon, 3570 Arizona; Henn Oona, 103 Beryl, both of Los Alamos, N. Mex. 87544

[21] Appl. No.: 28,536

[22] Filed: Mar. 8, 1993

Related U.S. Application Data

[63] Continuation-in-part of Ser. No. 866,624, Apr. 10, 1992, Pat. No. 5,222,536.

[51] Int. Cl.[5] ..... B65B 67/04

[52] U.S. Cl. ..... 141/390; 141/108; 141/315; 141/316; 141/114; 248/99; 15/257.1; 53/381.1

[58] Field of Search ..... 383/33; 53/381.1, 390; 15/257.1; 248/99-101; 141/313-316, 108, 114, 390, 391

[56] References Cited

U.S. PATENT DOCUMENTS

| | | | |
|---|---|---|---|
| 1,086,002 | 2/1914 | Stewart | 141/790 |
| 3,905,406 | 9/1975 | Cruse | 141/390 |
| 4,006,928 | 2/1977 | Beugin | 15/257.1 X |
| 4,299,365 | 11/1981 | Battle | 248/99 |
| 4,312,531 | 1/1982 | Cross | 15/257.1 X |
| 4,479,344 | 10/1984 | Edwards | 53/390 |
| 4,530,533 | 7/1985 | Dieter | 141/390 X |
| 4,548,372 | 10/1985 | Lutzker | 248/99 |
| 4,550,440 | 10/1985 | Rico | 383/33 |
| 4,659,045 | 4/1987 | Flynn | 248/99 |
| 4,664,348 | 5/1987 | Corsaut, III et al. | 248/99 |
| 4,884,603 | 12/1989 | Simpson | 141/390 |
| 4,940,200 | 7/1990 | Sawyer et al. | 248/99 X |
| 4,981,274 | 1/1991 | McVay et al. | 248/99 |
| 5,014,943 | 5/1991 | Nelson et al. | 248/99 |
| 5,050,920 | 9/1991 | Potticary | 248/100 X |
| 5,065,965 | 11/1991 | Aulabaugh | 248/99 |
| 5,080,308 | 1/1992 | Franks | 248/99 |
| 5,129,609 | 7/1992 | Tobin | 248/97 |
| 5,205,107 | 4/1993 | Herink | 141/390 X |
| 5,222,536 | 6/1993 | Hodgdon et al. | 141/390 |

FOREIGN PATENT DOCUMENTS

| | | | |
|---|---|---|---|
| 923477 | 3/1973 | Canada | 15/257.1 |
| 2503571 | 8/1976 | Fed. Rep. of Germany | 15/257.1 |
| 390538 | 4/1933 | United Kingdom | 141/391 |

*Primary Examiner*—Ernest G. Cusick
*Attorney, Agent, or Firm*—William A. Eklund

[57] ABSTRACT

A refuse collector for introducing solid refuse into commercial plastic trash bags is disclosed. One embodiment of the collector includes an open, peripheral frame having a collection tray hinged thereto, and a pair of bag expanders that are hinged thereto and extend rearwardly from the frame and into a plastic trash bag to hold the bag open. In a second embodiment the collector includes three inexpensive, interlocking disposable components. The collector is particularly adapted to collection of hazardous solid waste such as metal chips or refuse contaminated with hazardous, toxic or infectious materials. The collector may be used in a horizontal or vertical position.

10 Claims, 9 Drawing Sheets

REFUSE COLLECTOR WITH HINGED COLLECTION TRAY FOR USE WITH A TRASH BAG

BACKGROUND OF THE INVENTION

This is a continuation-in-part of the applicants' copending U.S. patent application Ser. No. 07/866,624, filed Apr. 10, 1992, now issued as U.S. Pat. No. 5,222,536 on Jun. 29, 1993.

1. Field of the Invention

The invention described and claimed herein is generally related to waste disposal devices and apparatus. More specifically, the present invention is related to devices for manual collection of solid waste that may be hazardous or toxic.

2. Description Of Related Art Including Information Disclosed Under 37 CFR 1.97-1.99

The present invention is directed to the common chore of collecting refuse in plastic trash bags for subsequent disposal. This is normally an uneventful task in the case of common household refuse, such as leaves and other household trash. However, it poses certain risks when the refuse contains materials that are hazardous, toxic or contaminated with infectious agents. In such situations the common problem of holding the bag open while sweeping or otherwise transporting the refuse into the bag results in an awkward situation that can expose the user to contact with the hazardous refuse. Some solid wastes are simply dangerous to handle and constitute physical hazards, for example sharp metal chips and slivers from industrial operations. Other industrial wastes constitute a risk of exposure to hazardous chemicals or radioactive materials. Wastes from medical facilities frequently contain infectious agents or other biohazards.

Various devices have been commercially available for assisting in holding a trash bag open while it is filled. None of the previously known devices, however, are adapted for the specific purpose of avoiding manual contact with the refuse as it is transported into a plastic trash bag.

Accordingly, it is the object and purpose of the present invention to provide a device to facilitate the introduction of refuse into common plastic trash bags.

More particularly, it is an object and purpose of the present invention to provide a device which facilitates the introduction of hazardous, toxic or infectious refuse into trash bags while minimizing the risk of contact with the user.

It is a further object of the present invention to provide a device that attains the foregoing objectives while and is also disposable and inexpensive to manufacture.

SUMMARY OF THE INVENTION

The present invention provides a refuse collector for use with a plastic trash bag. The refuse collector includes a rigid peripheral frame member defining a central opening therein. A collection tray is hinged to a lower edge of the peripheral frame. The collector further includes first and second bag expander arms which are hinged to the rear of the frame member and which are extendable rearwardly therefrom into a trash bag. The frame member and the expander arms are sized and adapted so that the expander arms hold the bag open and positioned to receive refuse introduced into the bag from the collection tray and through the opening in the frame member.

In the preferred embodiment the frame member includes a tubular lower frame arm, and the collection tray includes an integral hinge in the form of a continuous edge member thereof which is curled so to partially enclose the tubular lower frame arm, thereby functioning as a hinge to allow the collection tray to rotate about the lower frame arm.

In accordance with another aspect of the invention the frame member is generally rectangular and includes four frame arms connected by hinge joints, with the bag expander arms each being hinged to the hinge joints for swinging motion between a rearwardly extending position and a compact folded position for storage. The hinge joints include integral resilient detents for retaining said expander arms in either rearwardly extended or the folded positions. In the preferred embodiment the hinge joints are formed of a resilient polymeric material and are generally cylindrical in configuration, with each hinge joint including a rearwardly opening central cylindrical bore transected by a longitudinal slot passing through the hinge joint. The ends of the expander arms are insertable into the cylindrical bores of said joints and are retained by pivot pins.

In accordance with a second preferred embodiment of the present invention, the refuse collector includes bag expander arms in the form of planar side panels that are detachable from a planar peripheral frame, and the collection tray is an integral part of a planar peripheral frame. As will be seen from the more detailed description below, the advantage of this second preferred embodiment is that it can be manufactured entirely from sheet material such as cardboard or polymeric sheet materials, and consequently is inexpensive to manufacture and can be discarded after each use, along with the collected refuse, so that there is little or no risk of exposure to hazardous chemicals or other materials that might have accumulated on the refuse collector.

These and other aspects of the present invention will be more apparent upon consideration of the following detailed description of the invention, when taken with the accompanying drawings.

BRIEF DESCRIPTION OF THE DRAWINGS

The Figures set forth in the accompanying drawings form a part of this specification and are hereby incorporated by reference. In the Figures.

The structure and function of the invention is best understood by reference to the attached drawings when taken with the following detailed description of preferred embodiments of the invention.

DESCRIPTION OF THE PREFERRED EMBODIMENTS

Figure 1:
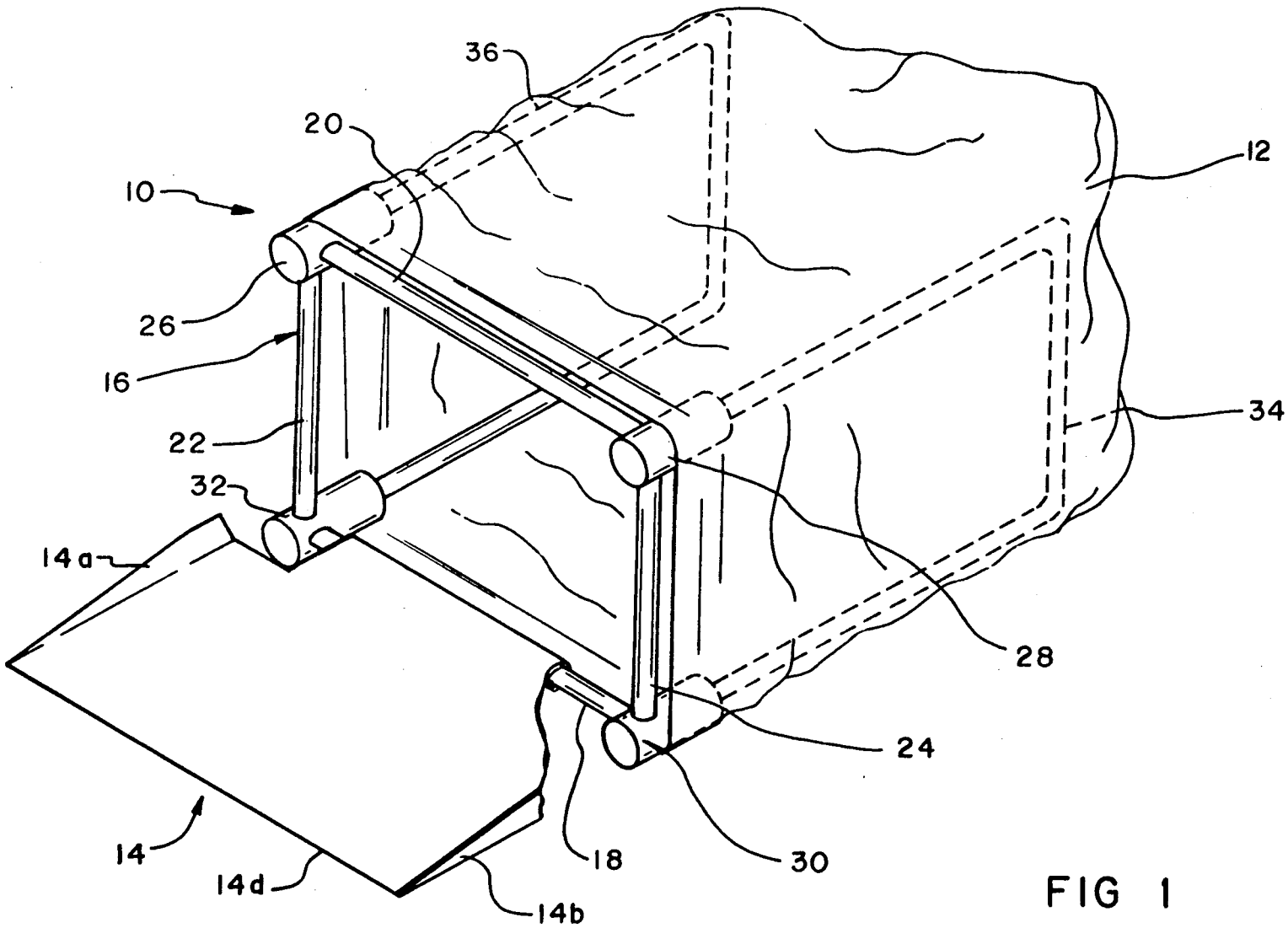
FIG. 1 is an isometric view of a preferred embodiment of the refuse collector of the present invention, shown as used with a plastic trash bag.

Referring first to FIGS. 1 through 7, there is illustrated a refuse collector 10 which constitutes a first preferred embodiment of the present invention. FIG. 1 illustrates the refuse collector 10 as it is ordinarily used in combination with a plastic trash bag 12. The trash bag 12 forms no part of the present invention.

Figure 5:
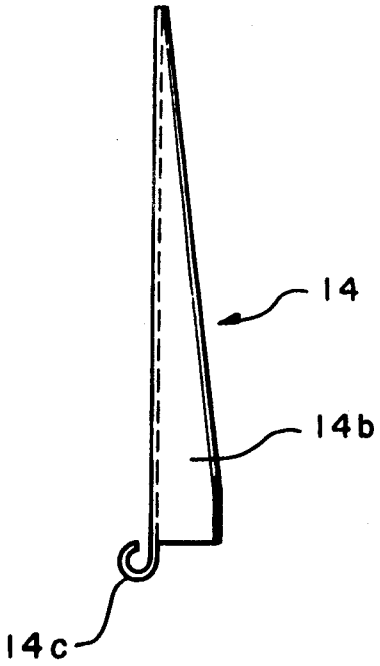
FIG. 5 is a side view of the collection tray of the refuse collector.

The collector 10 includes a collection tray 14, shown separately in FIG. 5, which is hinged to a rectangular frame 16. The rectangular frame 16 includes lower and upper frame arms 18 and 20, respectively, and side arms 22 and 24.

Figure 3:
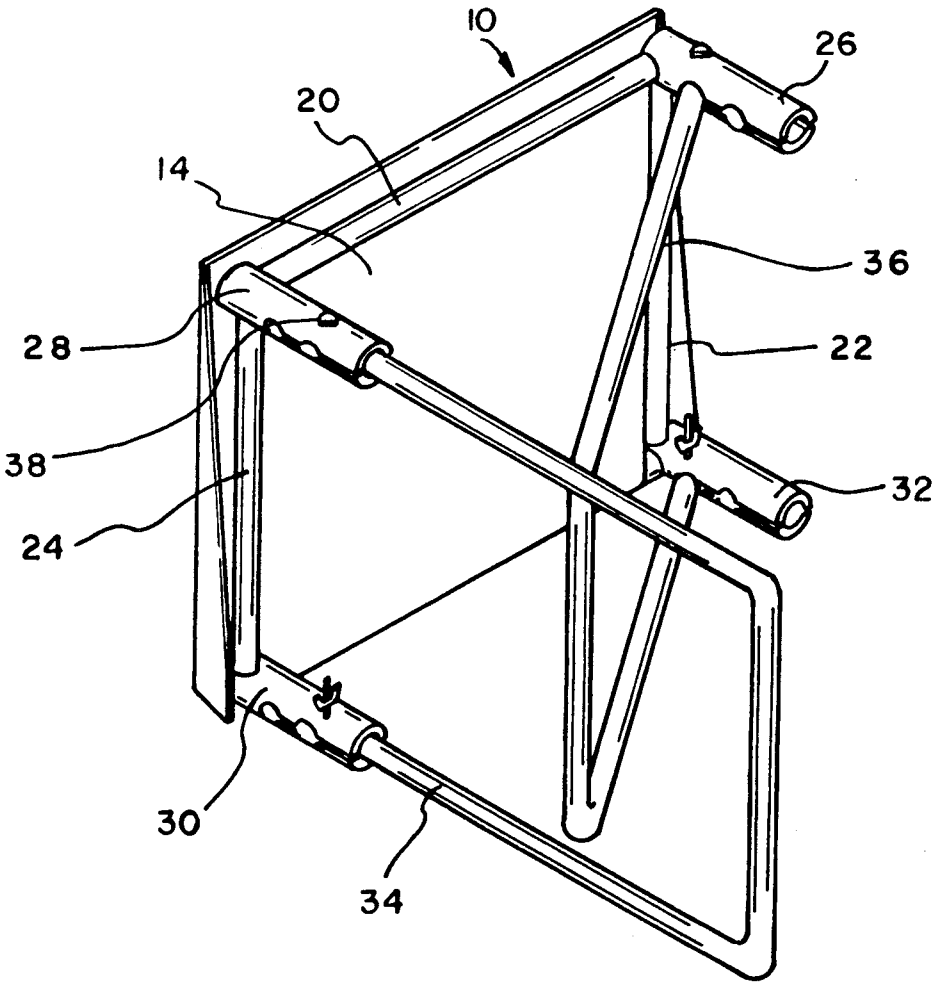
FIG. 3 is a rear isometric view of the refuse collector being folded into a compact folded position for storage.
Figure 4:
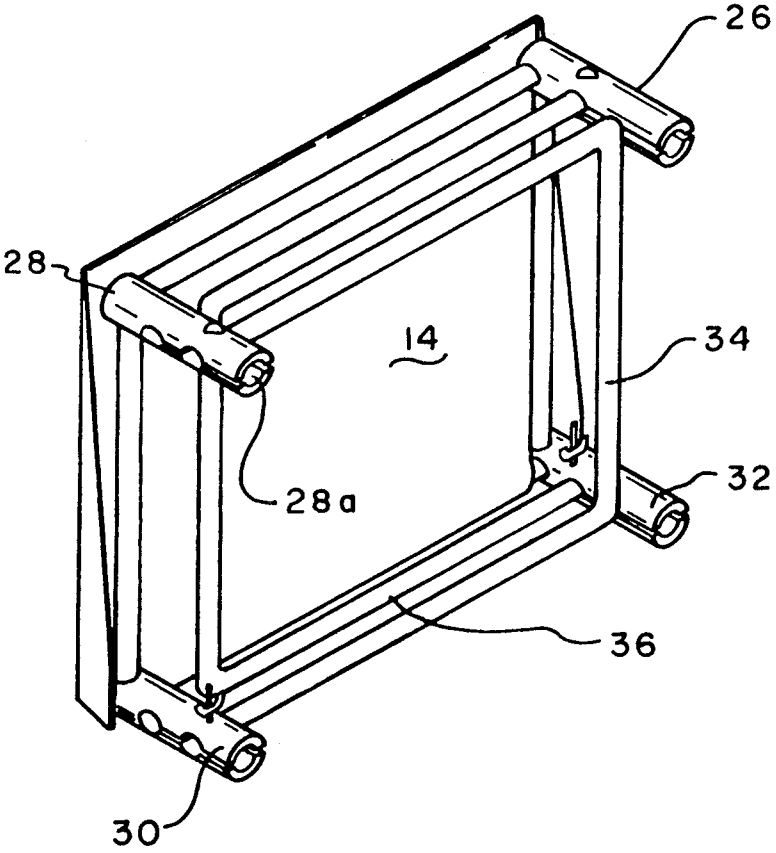
FIG. 4 is a rear isometric view of the refuse collector in the folded configuration.

The collection tray 14 includes integral side walls 14*a* and 14*b* which are upturned at angles of approximately 45 degrees and which function to retain refuse on the tray 14 and guide the refuse into the bag 12. The collection tray 14 further includes an integral hinge 14*c* (FIG. 5) which extends through an angle of approximately 210 degrees so as to partially encircle the lower frame arm 18, thereby retaining the tray 14 to the arm 18 while also allowing the tray 14 to swing freely about the arm 18. The integral hinge 14*c* serves two purposes. First, it allows the tray 14 to swing downwardly freely so that the sharpened outer edge 14*d* of the tray 14 is flushly positioned against the ground, so that refuse can be swept onto the tray 14 with optimum collection efficiency. The hinge 14*c* also allows the tray 14 to be manually swung upwardly, both to dump refuse into the bag 12 and to allow the tray 14 to be folded into a compact storage position, as described further below and as shown in FIGS. 3 and 4.

The rectangular frame 16 includes four cylindrical hinge joints 26, 28, 30 and 32, which are substantially identical and which function to rigidly connect the frame arms 18, 20, 22 and 24 together to form a rectangular open frame through which refuse is conveyed into the bag 12. The hinge joints 26, 28, 30 and 32 also function to retain a pair of U-shaped bag expander arms 34 and 36. The expander arms 34 and 36 function to hold the bag 12 open in an expanded position, as shown in FIG. 1.

Figure 2:
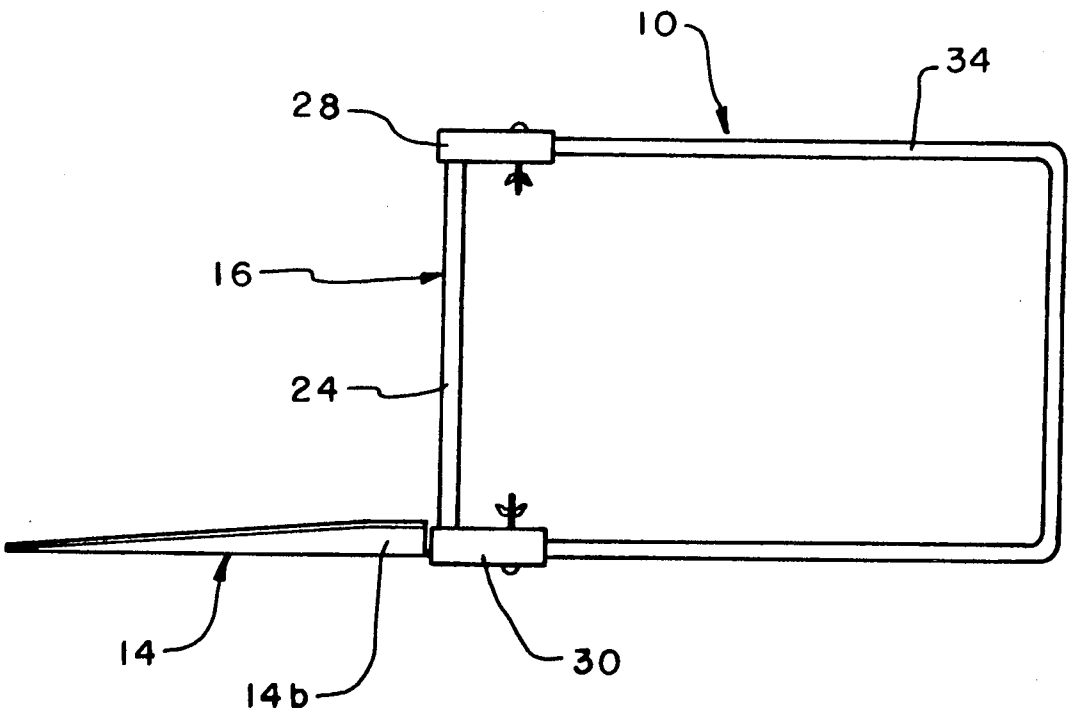
FIG. 2 is a side view of the refuse collector of FIG. 1, shown without a plastic trash bag.
Figure 7:
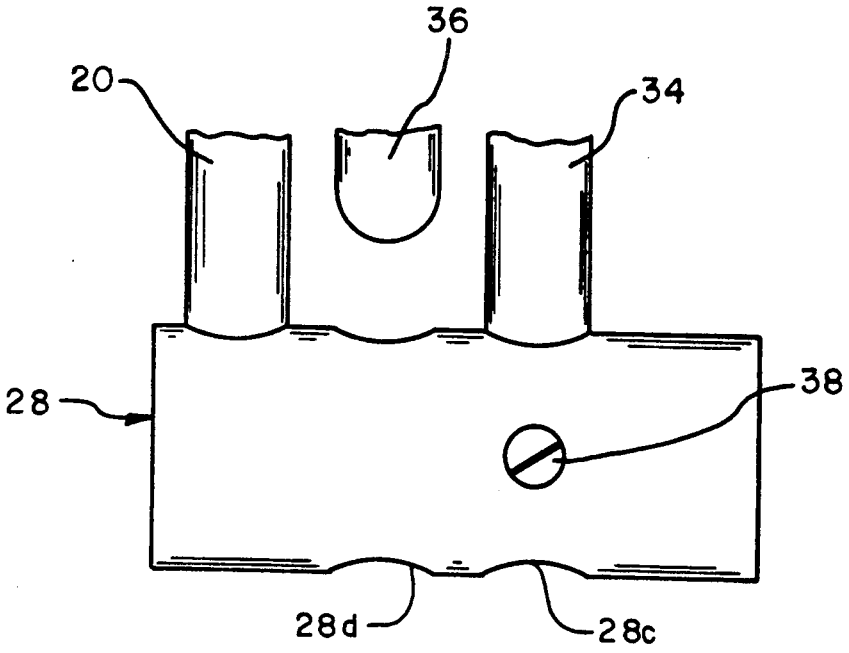
FIG. 7 is an enlarged plan view of the hinge joint of FIG. 6.
Figure 6:
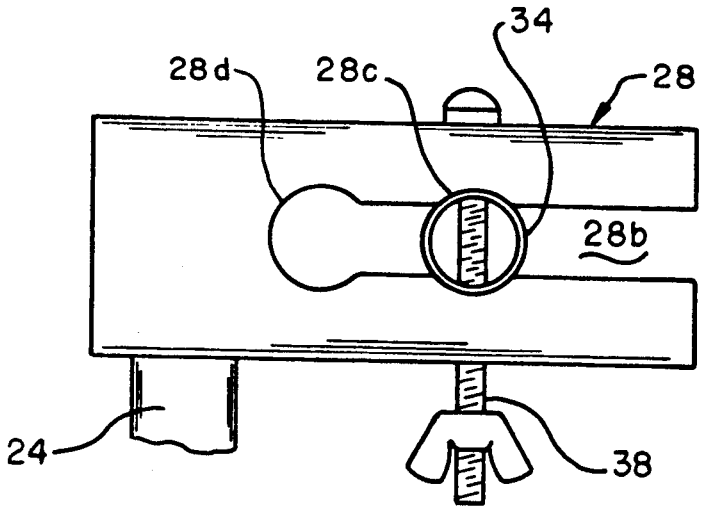
FIG. 6 is an enlarged side view of one of the hinge joints of the refuse collector.

The ends of the U-shaped expander arms 34 and 36 are hinged to the cylindrical hinge joints 26, 28, 30 and 32. FIGS. 6 and 7 illustrate in greater detail joint 28, which is illustrative of and identical to the other three hinge joints. The joint 28 includes a longitudinal bore 28*a* (FIG. 4) and a horizontal transverse slot 28*b* passing radially through the joint 28 and transecting the bore 28*a*. With the refuse collector 10 in the open position, as shown in FIGS. 1 and 2, the tubular end of expander arm 34 extends into the bore 28*a* and is retained by a pivot pin 38. The slot 28*b* allows the body of the joint 28 to flex sufficiently to allow the arm 34 to swing about the pivot pin 38 between the extended position, shown FIGS. 1 and 2, and a folded position, as shown in FIG. 4. In the folded position the end of the arm 34 resides in a cylindrically curved transverse rear detent 28*c* (FIGS. 6 and 7). Joint 28 includes a similar forward detent 28*d* which is located at the end of the slot 28*b*. The joint 28 is made of a resilient polymer, such that the end of tubular U-shaped arm 34 is resiliently retained in the extended position in the tubular bore 28*a* and is also resiliently retained in the folded position by the rear detent 28*c*.

The hinge joints 26, 28, 30 and 32 are all identical in construction to facilitate interchangeable construction and use. Each joint 26, 28, 30 and 32 includes a rear detent, such as 28*c*, as well as a forward detent such as 28*d*. In assembly, the expander arm 34 is hinged at the rear detent 28*c* of hinge joint 28 and the corresponding rear detent of joint 30, and the opposite expander arm 36 is hinged at the forward detents of hinge joints 26 and 32. This arrangement allows the two expander arms 34 and 36 to be folded into a compact position in which they are offset from one another, as shown in FIGS. 4 and 7.

In operation, the refuse collector 10 is opened to its extended position and inserted into a trash bag 12 as illustrated in FIG. 1. The collector is then laid on the ground and solid refuse is swept or raked onto the collection tray 14, from which it may be either swept into the bag 12 or dumped into the bag by raising the tray 14.

It will be appreciated that the refuse collector 10 can be used in a vertical position when appropriate. For this purpose, in the preferred embodiment the U-shaped expander arms 34 and 36 are flattened at their ends distal from the frame 16, so that the collector 10 may function in another capacity as a self-supporting stand that maintains the plastic trash bag 12 in an open, upright and fully expanded position. Further, when used in this capacity the tray 14 functions as a lid, covering the opening of the bag 12 when temporarily not in use, and which can also be opened and swung outwardly and downwardly alongside the outside of the bag 12 where it is out of the way while refuse is being introduced into the bag.

It will be appreciated that the refuse collector of the present invention is of particular application in connection with the collection and disposal of toxic or hazardous wastes, such as may be encountered in industrial or medical facilities, where contact with the refuse is sought to be avoided. One example is metal chips, which can be sharp and dangerous to handle manually, and which can also be contaminated with toxic oils or solvents. The collector is also useful in connection with refuse that may be contaminated with infectious substances, such as medical or sanitary refuse. In all of these cases the refuse can be collected for disposal without exposing the user to manual contact.

Although the embodiment of the refuse collector described above is intended to be reusable, the collector may also be manufactured in a disposable embodiment that is simplified and more inexpensive to construct. Such an embodiment may be simply left in the plastic trash bag and discarded along with the refuse when the bag has been filled. Such an embodiment is particularly useful for applications where it is expected that the collector itself will become contaminated with toxic or infectious materials, such that it is preferable to avoid any handling of the contaminated collector after it has been used.

FIGS. 8 through 12 illustrate a refuse collector 50 which is a second preferred embodiment of the present invention, and which is designed and constructed in a manner that is even more particularly suited to applications in which it is desirable to utilize an inexpensive, disposable embodiment of the invention.

Referring to FIGS. 8 through 12, the refuse collector 50 includes three interlocking and detachable components; namely, a planar peripheral frame 52, a planar left side panel 54, and a planar right side panel 56. The frame 52 and side panels 54 and 56 may be constructed of any suitable sheet material, for example cardboard or a polymeric sheet material such as polyethylene, polyurethane, or acrylic polymers. The side panels 54 and 56 function as bag expanders and also support the frame 52 in a self-standing, upwardly opening position when desired, as described further below.

The frame 52 is generally rectangular and includes an integral collection tray 52*a*. The collection tray 52*a* is hinged to the frame 52 along hinge line 52*b*. In the case of a polymeric sheet material, the collection tray 52*a* may be hinged to the frame 52 by the type of integral hinge known in the industry as a "living hinge." In the case of a cardboard frame 52, the hinge 52*a* may be hinged by means of perforations or a crease along the hinge line 52*b*.

The integral collection tray 52*a* includes two elongate rectangular slots 52*c* and 52*d*. The slots 52*c* and 52*d* are located in the corners of the tray 52*a* adjacent the ends of the hinge line 52*b*, and are oriented with their longitudinal axes extending perpendicular to the hinge line 52*b*. As will be described further below, the rectangular slots 52*c* and 52*d* function to connect the side panels 54 and 56 to the frame 52, while also connecting the tray 52*b* to the side panels 54 and 56 so as to maintain the tray 52*b* in an open, deployed position. The collection tray 52*a* is provided with a tapered outer edge to facilitate sweeping of fine debris onto the tray 52*a*.

Figure 11:
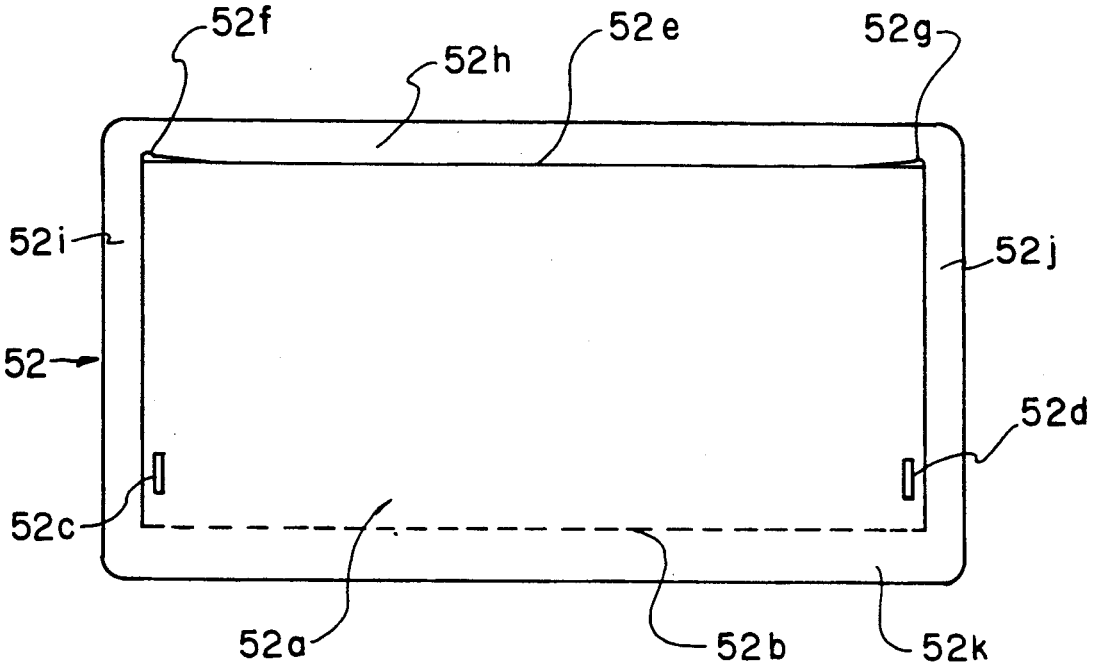
FIG. 11 is a plan view of the planar peripheral frame with integral collection tray, of the embodiment of FIGS. 8 and 9.

The tray 52*b* is separated from the frame 52 along a cut-out line 52*e*, shown in FIG. 11, which enables the tray 52*b* to folded outward from the pane of the frame 52 along the hinge line 52*b*. The frame 52 further includes two angular notches 52*f* and 52*g*, also shown in FIG. 11, which are located along the cut-out line 52*e* at the upper corners of the tray 52*a*. As described further below, the notches 52*f* and 52*g* operate to allow the side panels 54 and 56 to be positioned and retained in place within the opening in the frame that is created when the tray 52*a* is folded outwardly.

When the collection tray 52*a* is swung outward into its open position, there is thereby formed a large opening in the frame 52, which opening is bounded by an upper frame member 52*h*, side members 52*i* and 52*j*, and a lower frame member 52*k*.

Figure 12:
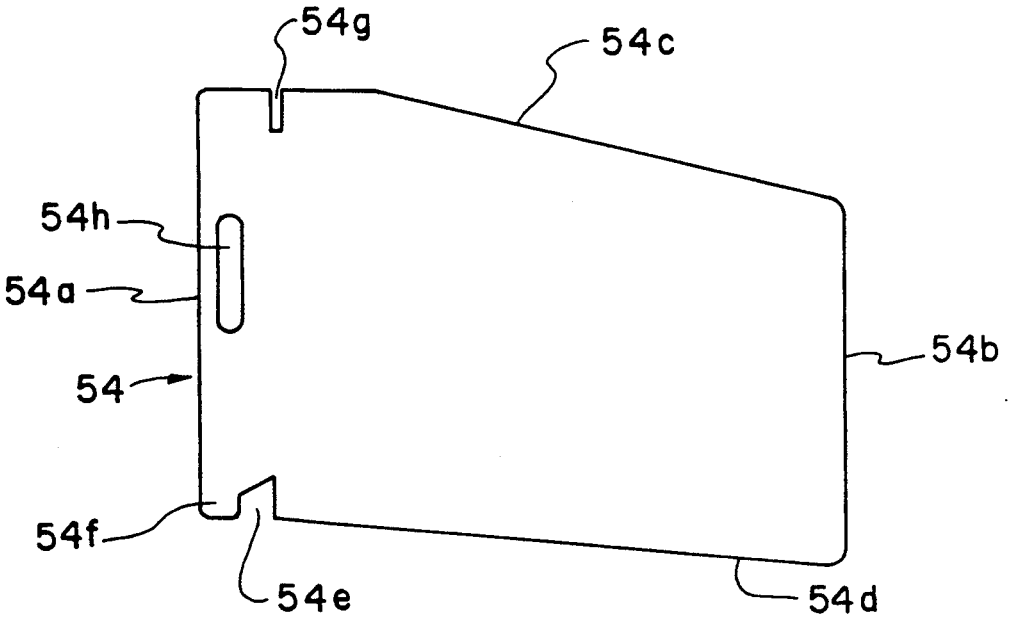
FIG. 12 is a plan view of one side panel of the embodiment of FIGS. 8 and 9.

The two side panels 54 and 56 are substantially identical in construction and both can be described by reference to side panel 54 as shown in FIG. 12.

Side panel 54 is generally in the shape of a slightly offset parallelogram having a front edge 54*a*, rear edge 54*b*, and upper and lower edges 54*c* and 54*d* respectively. The panel 54 includes a notch 54*e* in its lower edge 54*d*, adjacent the front corner of the panel 54, which serves to form a tongue 54*f* that is engageable with the rectangular slot 52*c* in the collection tray 52*a*. The side panel 54 also includes a vertical, upwardly opening slot 54*g* in the upper edge 54*c*, located near the front edge 54*a*. The slot 54*g* is engageable with the upper edge of the peripheral frame 52, and in particular is engageable with the notch 52*f* of the peripheral frame 52, whereby the side panel 54 may be retained in position affixed to the frame 52. Further, the side panel 54 includes a closed slot 54*h* adjacent its front edge 54*a*, which functions as a handle when the refuse collector 50 is assembled.

The refuse collector 50 is assembled by first opening the collection tray 52*a* to its open position. The front end of side panel 54 may then be inserted into the resulting opening in the frame 52, and the tongue 54*f* of side panel 54 inserted in the slot 52*c* of the collection tray. The side panel 54 is then rotated into position adjacent the left side member 52*i* of the frame 52, with the slot 54*g* engaging the upper edge member 52*h*. As the side panel 54 is rotated fully into position, the slot 54*g* engages notch 52*f*, which includes a small detent, and is thereby retained in the fully assembled position. It will be appreciated that the tongue 54*f* serves a dual function of attaching the side panel 54 to the frame 52, while also maintaining the collection tray 52*a* in the open position.

Figure 8:
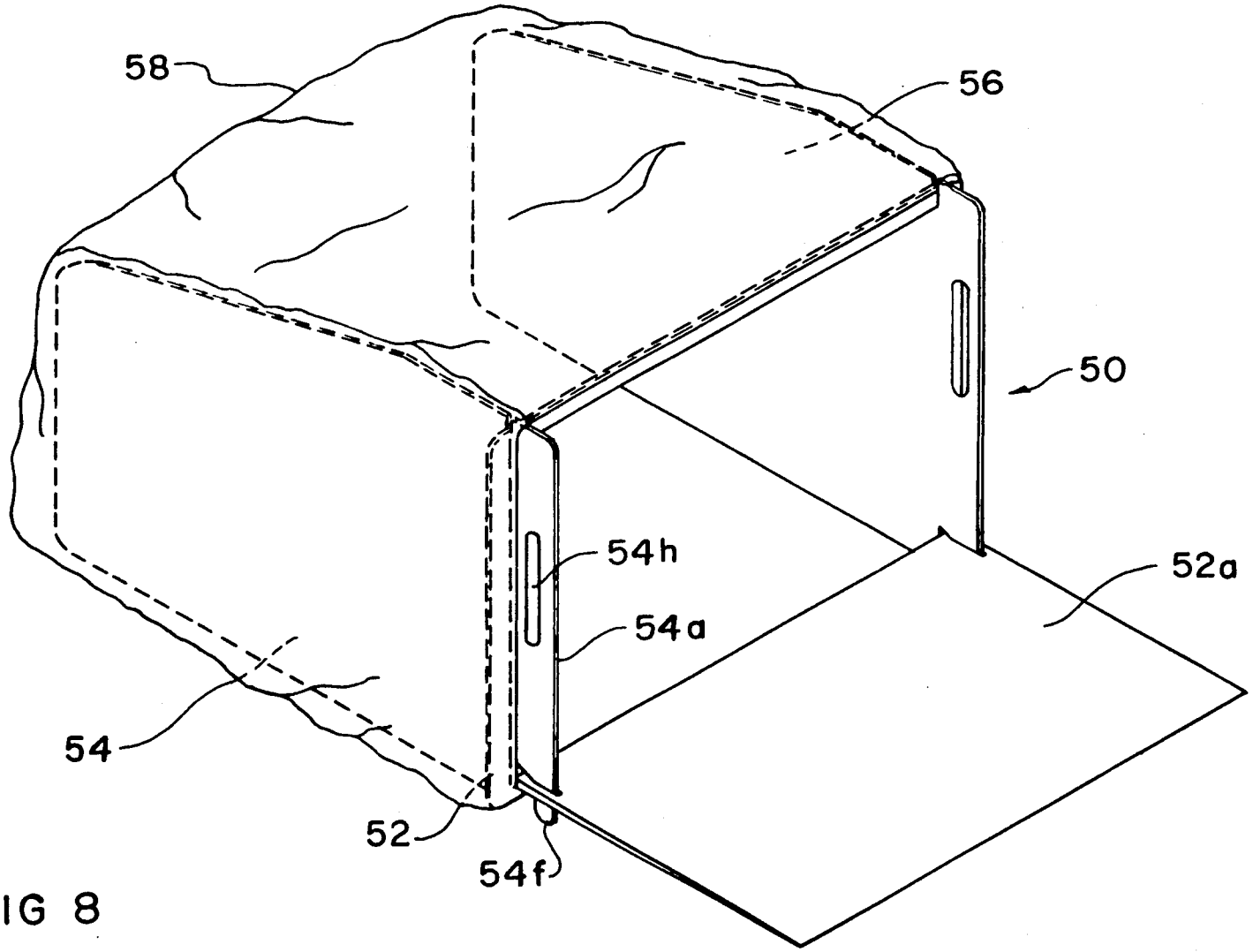
FIG. 8 is an isometric view of a second preferred embodiment of the present invention, shown as it is employed with a plastic trash bag.
Figure 9:
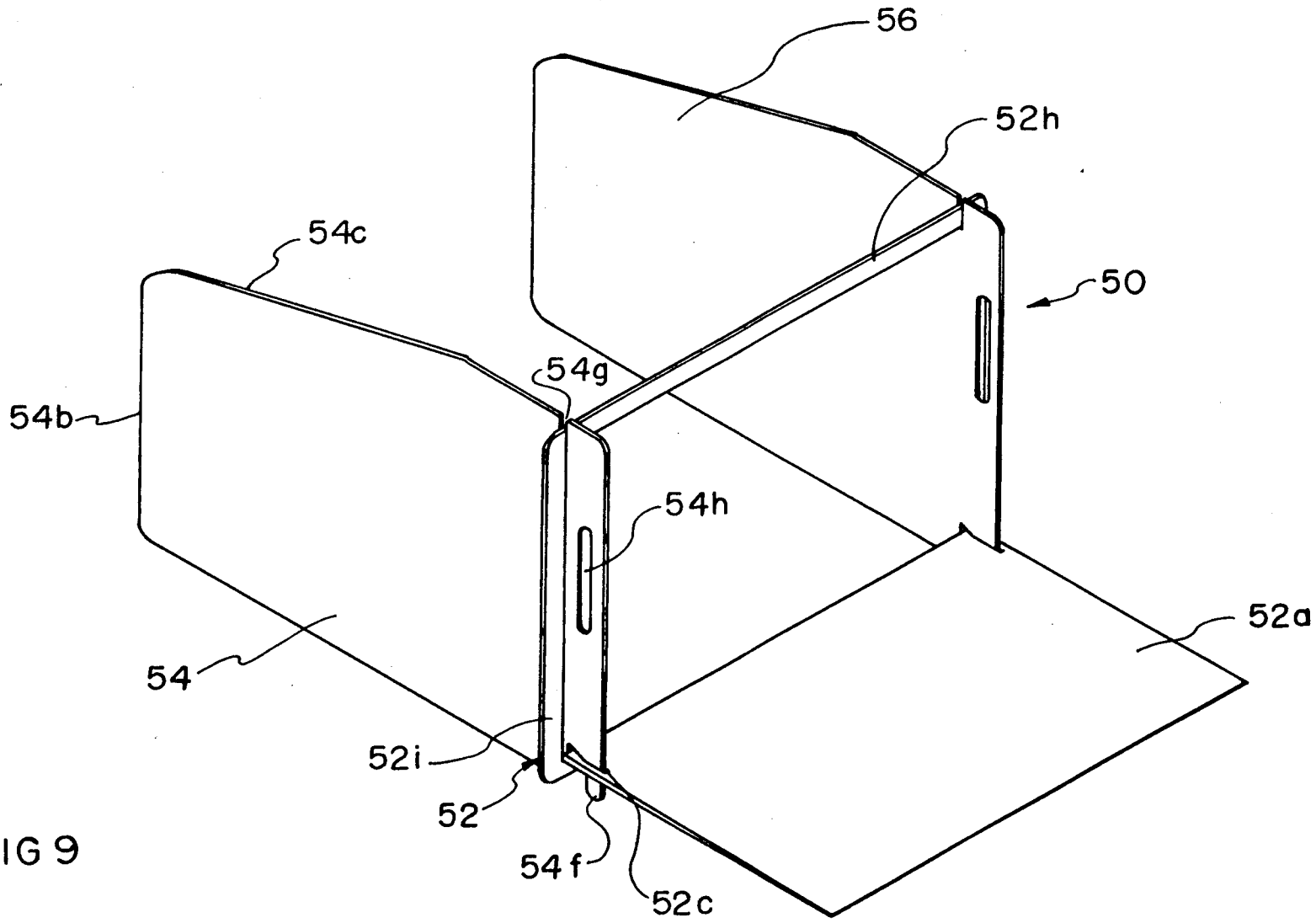
FIG. 9 is an isometric view as in FIG. 8, without the plastic trash bag.
Figure 10:
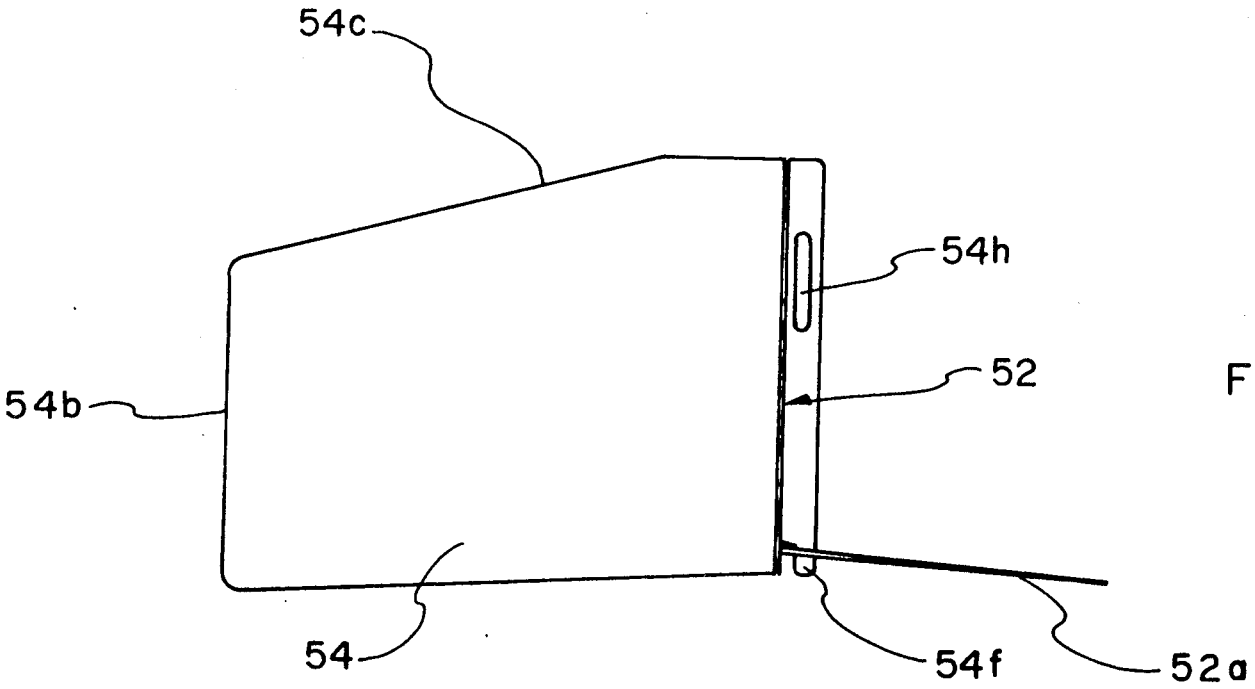
FIG. 10 is a side view of the refuse collector of FIGS. 8 and 9.

The same process is repeated with right side panel 56 to result in the deployed assembly illustrated in FIG. 9. Assembled refuse collector is then inserted in a plastic bag 58, as shown in FIG. 8.

It will be noted that the bag 58 and refuse collector 50 may be handled and transported as a unit. If desired the bag 58 may be attached to the peripheral frame 52 by any of several well known methods, and in particular may be quite simply attached by folding the edge of the bag 58 around the upper edge member 52*h* of the frame 52, and pinching the bag between the side panels 54 and 56 and the upper edge member 52*h* as the side panels 54 and 56 are locked into position.

The bag 58 and collector 50 may be stood on end, resting on the rear edges of the side panels, with the openings of the bag 58 and frame 52 opening upwardly. In this position, the entire assembly is self-supporting in the upwardly opening position.

It will be appreciated that the second preferred embodiment described above can be manufactured sufficiently easily and economically that it can be discarded along with the plastic bag and the waste collected in it. This feature is particularly useful in connection with the collection and disposal of solid waste that is contaminated with hazardous chemicals or infectious agents.

The present invention has been described and illustrated with reference to particular preferred embodiments. Nevertheless, it will be understood that various modifications, alterations and substitutions may be apparent to one of ordinary skill in the art, and that such modifications, alterations and substitutions may be made without departing from the essential invention. Additionally, although the present invention is described as being useful in connection with the disposal of hazardous or toxic wastes, it is by no means intended that the present invention be limited to such uses; and in fact it is contemplated that the invention will be useful in connection with the disposal of ordinary household refuse as well. Accordingly, the present invention is defined only by the following claims.

The embodiments of the invention in which patent protection is claimed are:

1. A refuse collector for use with a plastic trash bag, said refuse collector comprising a planar peripheral frame member having an integral collection tray formed therein, said collection tray being foldable outwardly from the plane of said frame member to form an opening in said frame member, and first and second planar side panels, said side panels being insertable through said opening in said frame member and engageable with said frame member so as to extend rearwardly from said frame member, said frame member and said side panels being sized to cooperably fit inside common plastic trash bags for the purpose of facilitating the collection and disposal of solid waste.

2. The refuse collector defined in claim 1 wherein said peripheral frame member is formed of a sheet material, and wherein said integral collection tray is foldable outwardly from said frame member along a hinge line.

3. The refuse collector defined in claim 2 wherein said side panels are formed of a sheet material, and wherein said collection tray includes two elongate slots adjacent said hinge line, and wherein said side panels include integral tongues that are engageable with said slots in said collection tray, whereby said side panels are connected to said frame and said collection tray is maintained in an outwardly opening position.

4. The refuse collector defined in claim 3 wherein said peripheral frame member includes an upper edge member, and wherein said side panels each include an upper edge having a vertical upwardly opening slot formed therein, and wherein said slots engage said upper edge member of said peripheral frame member on assembly, thereby further retaining and affixing said side panels to said peripheral frame member.

5. The refuse collector defined in claim 4 wherein said side panels each include a straight rear edge member, whereby the refuse collector and a plastic trash bag can be stood in a self-supporting upwardly opening position.

6. The refuse collector defined in claim 4 wherein said peripheral frame member further includes a lower edge member, and wherein said integral collection tray is separated from said planar peripheral frame member along a cut-out line extending along said lower edge member, and wherein said upper edge member includes notches formed therein at the opposite ends thereof which are positioned adjacent the upper corners of said collection tray when said collection tray is folded upwardly into a closed position, whereby said side panels may be rotated into position about an axis perpendicular to the plane of said peripheral frame member and retained by engagement of said upwardly opening slots of said side members with said notches in said frame member.

7. The refuse collector defined in claim 6 wherein said collection tray includes a tapered outer edge.

8. The refuse collector defined in claim 7 wherein said side panels include front edges, and wherein said side panels include integral slot openings therein adjacent said front edges, whereby the refuse collector and an attached trash bag may be handled and transported as a unit.

9. The refuse collector defined in claim 8 wherein said sheet material is a polymeric material, and said hinge line is a living hinge.

10. The refuse collector defined in claim 8 wherein said sheet material is cardboard and said hinge line is formed by perforations or creasing of said cardboard.

* * * * *